US010181660B2

(12) United States Patent
Zagroun

(10) Patent No.: US 10,181,660 B2
(45) Date of Patent: Jan. 15, 2019

(54) ELECTRICAL CONTACT AND SOCKET-OUTLET COMPRISING SUCH AN ELECTRICAL CONTACT

(71) Applicant: SOCIETE D'EXPLOITATION DES PROCEDES MARECHAL, Saint Maurice (FR)

(72) Inventor: Francis Zagroun, Neuilly sur Seine (FR)

(73) Assignee: Societe D'Exploitation Des Procedes Marechal, Saint Maurice (FR)

( * ) Notice: Subject to any disclaimer, the term of this patent is extended or adjusted under 35 U.S.C. 154(b) by 0 days.

(21) Appl. No.: 15/814,421

(22) Filed: Nov. 16, 2017

(65) Prior Publication Data

US 2018/0151964 A1 May 31, 2018

Related U.S. Application Data

(63) Continuation of application No. PCT/FR2016/052285, filed on Sep. 12, 2016.

(30) Foreign Application Priority Data

Sep. 18, 2015 (FR) ..... 15 58816

(51) Int. Cl.
*H01R 4/58* (2006.01)
*H01R 13/24* (2006.01)
(Continued)

(52) U.S. Cl.
CPC ..... *H01R 4/58* (2013.01); *H01R 13/2421* (2013.01); *H01R 13/652* (2013.01); *H01H 1/58* (2013.01); *H01R 4/36* (2013.01); *H01R 13/33* (2013.01)

(58) Field of Classification Search
CPC ..... H01R 2103/00; H01R 9/0524; H01R 9/0521; H01R 13/622; H01R 13/6592; H01R 24/40; H01R 13/5202; H01R 13/6581; H01R 24/38; H01R 9/05; H01R 13/5205; H01R 9/0518; H01R 13/658; H01R 13/506
See application file for complete search history.

(56) References Cited

U.S. PATENT DOCUMENTS 4,176,905 A 12/1979 Marechal
4,804,338 A * 2/1989 Dibble ..... H01R 4/72 29/859
(Continued)

FOREIGN PATENT DOCUMENTS

FR 1398945 A 5/1965
FR 2063662 A5 7/1971

*Primary Examiner* — Truc Nguyen
(74) *Attorney, Agent, or Firm* — The Webb Law Firm

(57) ABSTRACT

An electrical contact (10) comprising a braid (12) extending longitudinally and presenting a first end (12*a*) and a second end (12*b*) opposite from the first end (12*a*) in the longitudinal direction (Z), a contact head (14) mounted on the first end (12*a*), and a connection element (16) mounted on the second end (12*b*), wherein the free length X of the braid or the equivalent (12) and the sum Y of the volumes of the material of the contact head (14) and the connection element (16) satisfy the relationship:

$$Y \geq aX - b$$

where a is a number lying in the range 10 to 15, and b is a number lying in the range 80 to 110, Y being expressed in cubic millimeters, while X is expressed in millimeters.

14 Claims, 2 Drawing Sheets

(51) Int. Cl.

| | |
|---|---|
| ***H01R 13/652*** | (2006.01) |
| *H01H 1/58* | (2006.01) |
| *H01R 4/36* | (2006.01) |
| *H01R 13/33* | (2006.01) |

(56) References Cited

U.S. PATENT DOCUMENTS 5,246,376 A * 9/1993 Schuhl ..... H01R 9/0524 439/462
6,423,952 B1 * 7/2002 Meisiek ..... H05B 3/06 219/541
6,815,610 B2 * 11/2004 Kuboshima ..... H01R 9/032 174/360
9,017,110 B2 * 4/2015 Guillanton ..... H01R 9/0503 174/34
2011/0028023 A1 * 2/2011 Mahoney ..... H01R 24/52 439/353
2011/0045698 A1 * 2/2011 Kelly ..... H01R 13/719 439/607.01
2012/0129385 A1 * 5/2012 Amato ..... B32B 15/085 439/502
2012/0252237 A1 * 10/2012 Montena ..... H01R 4/646 439/98
2012/0282810 A1 * 11/2012 Myong ..... H01R 4/01 439/607.41
2013/0102185 A1 * 4/2013 Mulfinger ..... H01R 13/516 439/460
2013/0178088 A1 * 7/2013 Mangus ..... H01R 13/5812 439/283
2014/0235101 A1 * 8/2014 Derbogen ..... H01R 9/032 439/607.01
2015/0104976 A1 * 4/2015 Myong ..... H01R 13/648 439/607.41
2016/0056585 A1 * 2/2016 Dunwoody ..... H01R 13/6592 439/607.41

* cited by examiner

ELECTRICAL CONTACT AND SOCKET-OUTLET COMPRISING SUCH AN ELECTRICAL CONTACT

TECHNICAL FIELD

The disclosure relates to an electrical contact having a braid, and to a socket-outlet fitted with such an electrical contact.

The term "braid" is used to cover any assembly of braided or interlaced wires.

BACKGROUND

Electrical contacts are known that comprise a braid, together with a contact head and a connection element that are mounted on respective ends of the braid.

Nevertheless, when such a contact is subjected to large overcurrents, it can happen that the braid does not withstand the current and melts or even disintegrates.

One solution consists in using a braid of greater section. Nevertheless, such a solution is not appropriate for an electrical contact that is to be compact in order to enable it to be used in a confined space. There therefore exists a need in this sense.

SUMMARY

An embodiment relates to an electrical contact comprising a braid extending longitudinally and presenting a first end and a second end opposite from the first end in the longitudinal direction, a contact head mounted on the first end, a connection element mounted on the second end. At least one ring may be mounted on the braid between the contact head and the connection element, and the free length X of the braid (i.e. the total free length of the braid) and the sum Y of the volumes of the material of the contact head, of the connection element, and when provided, the ring, satisfy the relationship:

$$Y \geq aX - b \quad (1)$$

where:

a is a number lying in the range 10 (ten) to 15 (fifteen);

b is a number lying in the range 80 (eighty) to 110 (one hundred ten);

Y is expressed in cubic millimeters ($mm^3$);

X is expressed in millimeters (mm);

a is expressed in square millimeters ($mm^2$); and b is expressed in cubic millimeters ($mm^3$).

It can be understood that the contact head is the portion of the contact that serves to make electrical contact with a pin, e.g. a pin of a plug, while the connection element is an element that serves to connect the contact to an electric wire. It can also be understood that the at least one ring is optional, i.e. in some embodiments the electrical contact has one or more rings, whereas in other embodiments the contact does not have any ring.

Below, and unless specified to the contrary, the term "ring" should be understood as "the at least one optional ring". Likewise, below, and unless specified to the contrary, the term "braid" should be understood as "braid".

It can be understood that the free length of the braid is the sum of lengths in the longitudinal direction of portions of the braid that are free, i.e. that are not covered by or in contact with any element selected from the contact head, the connection element, and the ring. Thus, when the contact does not have a ring, the free length of the braid is the distance between the contact head and the connection element. When the contact includes a single ring, the free length is the sum of the length between the contact head and the ring plus the length between the ring and the connection element. When the contact has a plurality of rings, the free length is the sum of the length between the contact head and the adjacent ring, plus the length between the rings of each pair of adjacent rings, plus the length between the connection element and the adjacent ring. Throughout the description and unless specified to the contrary, the length is measured along the longitudinal direction.

It can also be understood that the free length is a length measured when the contact, and thus the braid, is not subjected to any stress, in particular any traction or compression stress along the longitudinal direction. Thus, the free length is considered when the braid is not subjected to any mechanical stress, or in other words, when the braid is "at rest", from a mechanical point of view.

The volume of material of the contact head that is to be taken into account is the volume of the material of the main body of the contact head that is mounted on the braid. Likewise, the volume of material of the connection element that is to be taken into account is the volume of material of the main body of the connection element that is mounted on the braid. Thus, if additional elements are mounted on the contact head and/or on the connection element, such as for example screws or circlips, the volume of material of those additional elements should not be taken into account. It can be understood that the ring comprises a single entity only, and forms a single part. The volume of material to be considered for the ring is thus the volume of material of that part. Consequently, the volume of material Y is the sum of the volumes of material of the main body of the contact head, of the main body of the connection element, and when present, of the optional ring. When the contact does not have a ring, the volume of material Y is the sum solely of the volumes of material of the main body of the contact head and of the main body of the connection element. Thus, under such circumstances, the volume of material taken into consideration that is to satisfy relationship (1) is shared between the contact head and the connection element.

The inventors have observed with surprise that the ability of the braid to withstand melting in the event of an overcurrent is a function of the volume of material Y in contact with the braid. The inventors have shown that the volume of material that is desirable for avoiding any degradation of the braid is a function of the free length of the braid. Thus, the free length X of the braid needs to be greater than the volume of material Y multiplied by a coefficient a, minus a constant b; a lies in the range 10 to 15, and b lies in the range 80 to 110. In other words, to avoid any degradation of the braid in the event of an overcurrent, the free length X and the volume of material Y needs to satisfy relationship (1). The inventors interpret this relationship (1) as defining a minimum volume of material capable of absorbing and diffusing all or part of the heat generated within the braid in the event of an overcurrent, thereby protecting the braid from the heating that is associated with such overcurrents, whereby degradation of the braid is avoided.

Such a contact is compact while presenting reliability in the event of overcurrent.

In some embodiments, a lies in the range 12 (twelve) to 13 (thirteen), and b lies in the range 90 (ninety) to 95 (ninety-five).

The inventors have observed that such coefficients make it possible to adjust more finely the ratio between the free length X and the volume of material Y for achieving better reliability, while ensuring compactness.

In some embodiments, b lies in the range 93 (ninety-three) to 94 (ninety-four).

The inventors have observed that such coefficients make it possible to adjust even more finely the ratio between the free length X and the volume of material Y in order to ensure even better reliability, while ensuring compactness.

In some embodiments, the area of the cross-section (i.e. the section perpendicular to the longitudinal direction) of the braid is greater than or equal to 2.0 $mm^2$ (two square millimeters).

The inventors have observed that relationship (1) is particularly well suited for braids having a cross-section of area greater than or equal to 2.0 $mm^2$, which generally presents acceptable intrinsic reliability against small overcurrents. Thus, the combined effect of selecting a minimum section for the braid together with relationship (1) makes it possible to ensure very good reliability in the face of greater overcurrents.

In some embodiments, the area of the cross-section of the braid is less than or equal to 3.0 $mm^2$.

The inventors have observed that the relationship (1) is particularly well suited for braids of cross-section of area that is less than or equal to 3.0 $mm^2$, which generally present acceptable compactness. Thus, the combined effect of selecting a maximum section for the braid together with relationship (1) makes it possible to ensure good compactness.

In some embodiments, the contact head comprises a first hollow cylindrical portion receiving the first end of the braid, while the connection element comprises a second hollow cylindrical portion receiving the second end of the braid.

It can be understood that the hollow cylindrical portions extend longitudinally around an end portion of the braid, where an end portion is a portion of the braid that extends longitudinally from an end of the braid. Thus, such a cylindrical portion serves to maximize the contact area between the braid and the contact head or between the braid and the connection element, thereby improving the removal of internal heat from the braid and thus improving the reliability needed in the event of overcurrent.

In some embodiments, the first hollow cylindrical portion and/or the second hollow cylindrical portion and/or the optional ring is/are crimped on the braid.

It is to be understood that the crimping is crimping performed in a direction perpendicular to the longitudinal direction. Crimping is generally easy to perform and inexpensive. Because of the way it deforms material, it also serves to reduce locally the size of the crimped portion, while providing reliable contact between the braid and the crimped portion.

In some embodiments, the braid, the contact head, the connection element, and the optional ring are made of copper or of a copper-based alloy, or of silver, or of a silver alloy.

It can be understood that a copper-based alloy is an alloy comprising at least 50% by weight of copper. Likewise, a silver-based alloy is an alloy comprising at least 50% by weight of silver. Copper and silver present good thermal and electrical conductivity properties, whereby the portions in contact with the braid easily absorb and diffuse the heat from the braid in the event of overcurrent, while providing good electrical conductivity for the contact. This makes it possible to obtain a contact that is effective, compact, and capable of withstanding overcurrents.

In some embodiments, the contact head is of the end contact type.

A contact of the "end contact" type is a contact where the electrical connection with another contact, e.g. a pin, is provided by a distal end face, specifically a distal end face of the contact head, this distal end face being substantially perpendicular to the longitudinal direction. Such a contact is configured to co-operate in abutment against a complementary end face of a pin, e.g. a distal end face, the contact between the two faces generally being made with a certain amount of pressure. A contact comprising a braid is particularly suitable for providing contacts of the "end contact" type, the braid possibly being capable of deforming in the longitudinal direction so as to ensure good quality electrical contact.

Further embodiments also provide a socket-outlet including at least one contact according to any of the embodiments described in the present description.

In some embodiments, said electrical contact is a ground contact.

A socket-outlet forms a female portion that may belong to a power connection (where the socket-outlet is generally secured to a wall), to an extension cord, or to a connector (where the socket-outlet generally forms part of a mobile socket), while a plug forms a male portion that may belong to a power connection (where the plug generally forms part of the movable connection), to an extension cord, or to a connector (where the plug is generally secured to an appliance).

In a general manner, a mobile socket comprises an socket-outlet and a handle or cap secured to said socket-outlet; a movable connection comprises a plug and a handle or cap secured to said plug; an extension cord is an assembly comprising a mobile socket and a movable connection; a power connection is an assembly comprising an socket-outlet and a plug; and a connector is an assembly comprising a mobile socket and a plug. The handle or cap may be incorporated with the socket-outlet or with the plug, in which circumstance said socket-outlet or plug also forms a mobile socket or a movable connection.

Within a socket-outlet, the contact that is most likely to be subjected to the greatest overcurrent is generally the ground contact. It may therefore be desirable to provide a socket-outlet in which the ground contact is particularly good at withstanding overcurrents.

BRIEF DESCRIPTION OF THE DRAWINGS

Advantages of the disclosure can be better understood on reading the following description of embodiments of the disclosure given as non-limiting examples. The description refers to the accompanying sheets of figures, in which.

DETAILED DESCRIPTION

Figure 1:
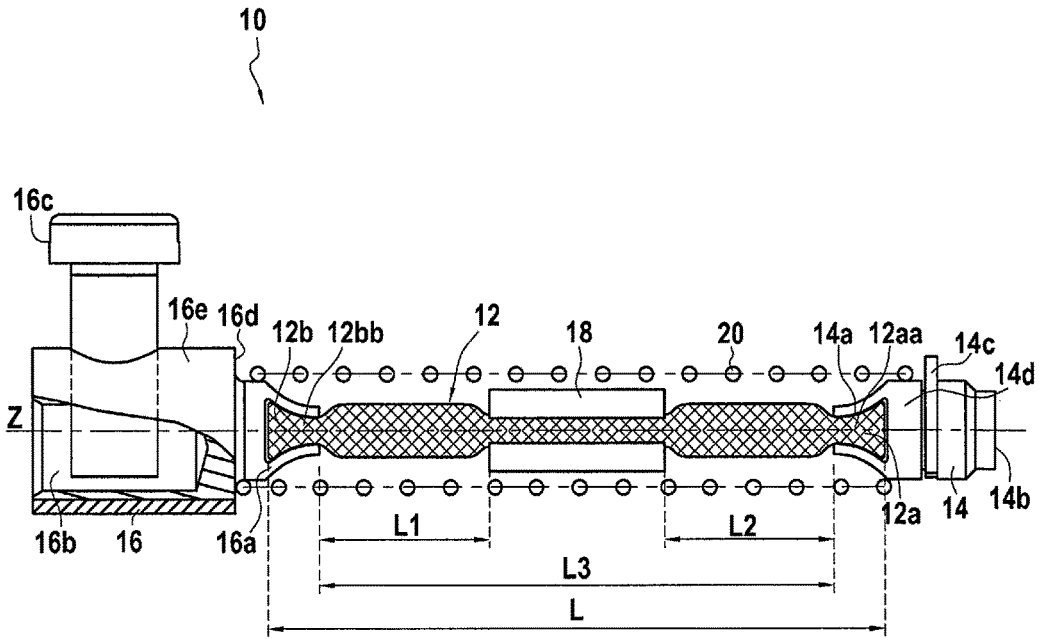
FIG. 1 shows an electrical contact.

FIG. 1 shows an electrical contact 10 comprising a braid 12, a contact head 14, and a connection element 16, the contact 10 extending along a longitudinal direction Z.

The braid 12 extends along the longitudinal direction Z and presents a first end 12*a* and a second end 12*b* opposite from the first end 12*a* in the longitudinal direction Z. In this example, the braid 12 is made of tinned copper. In this example, the area of the cross-section of the braid 12 is greater than or equal to 2.0 $mm^2$ and less than or equal to 3.0 $mm^2$. More precisely, in this example, the area of the cross-section of the braid 12 is equal to 2.2 $mm^2$.

The contact head 14 is mounted on the first end 12*a* of the braid 12. More particularly, in this example, the contact head 14 presents a first hollow cylindrical portion 14*a* receiving the first end 12*a* of the braid 12 and extending longitudinally over the first end portion 12*aa* of the braid 12. In this example, the first hollow portion 14*a* is crimped on the braid 12, and more particularly on the first end portion 12*aa*. In this example, the contact head 14 is of the end contact type and it presents a distal end face 14*b* configured to provide end contact. The contact head 14 is made of an alloy based on silver, and more precisely on an alloy of silver and nickel. In order to improve the quality of the end contact, the distal end face may be formed by a pellet made of some other material and fitted onto the remainder of the contact head, or else by a rivet that is crimped as a force-fit. It is assumed that the pellet or the rivet forms an integral portion of the main body 14*d* of the contact head 14, and is taken into consideration when calculating the volume of material for the contact head 14.

The connection element 16 is mounted on the second end 12*b* of the braid 12. More particularly, in this example, the connection element 16 presents a second hollow cylindrical portion 16*a* receiving the second end 12*b* of the braid 12 and extending longitudinally over the first end portion 12*bb* of the braid 12. In this example, the second hollow portion 16*a* is crimped onto the braid 12, and more particularly onto the second end portion 12*bb*. The connection element 16 also has a housing 16*b* configured to receive an electric wire, and fastener means, in this example a screw 16*c*, for fastening the wire to the connection element 16. The connection element is made of tinned copper.

In this example, the contact 10 presents a ring 18 mounted on the braid 12 by crimping, the ring 18 being arranged between the contact head 14 and the connection element 16. In general manner, the ring may be mounted at a distance from the contact head and from the connection element (i.e. the ring may not contact either the contact head or the connection element). In a variant, the ring may not be present. The ring 18 may comprise, for example, copper.

In this example, the contact 10 includes a compression spring 20 that serves to generate contact pressure against the contact head 14 when the contact head comes into abutment against a complementary element in order to ensure good quality end contact. The spring 10 contacts in abutment firstly with a shoulder 16*d* of the contact element 16 and secondly with a circlip 14*c* of the contact head 14.

At rest, in this example, the spring 20 does not exert any stress on the braid 12, which, at rest, presents a total length L. In this example, the free length X of the braid is equal to the sum of the lengths L1 and L2. The length L1 is the free length of the braid between the connection element 16 and the ring 18. The length L2 is the free length of the braid between the ring 18 and the contact head 14. Thus, the total free length X of the braid 12 is indeed the sum of the two lengths L1 and L2, i.e.

$$X=L1+L2$$

In a variant, the contact 10 does not present a ring, such that the total free length X of the braid is equal to the length L3 between the connection element 16 and the contact head 14.

The sum Y of the volumes of material (i.e. the total volume Y) of the contact head 14, of the connection element 16, and of the ring 18 corresponds to the sum of the volumes of material of the main body 14*d* of the contact head 14 (i.e. the contact head 14 without the circlip 14*c*), of the main body 16*e* of the connection element 16 (i.e. the connection element 16 without the screw 16*c*), and of the ring 18. Since these three elements are crimped together, i.e. plastically deformed, it can be considered that the deformation to which they are subjected does not modify the volume of the material of each of these elements, such that the volume of material may be calculated when these elements are not deformed.

In this example, the free length X and the sum Y of the volumes of material satisfy the relationship:

$$Y \geq 12.6X-93.3 \quad (2)$$

where X is expressed in millimeters (mm), Y is expressed in cubic millimeters ($mm^3$), the coefficient a with a value of 12.6 is expressed in square millimeters ($mm^2$), and the coefficient b with a value of 93.3 is expressed in cubic millimeters ($mm^3$).

Figure 2:
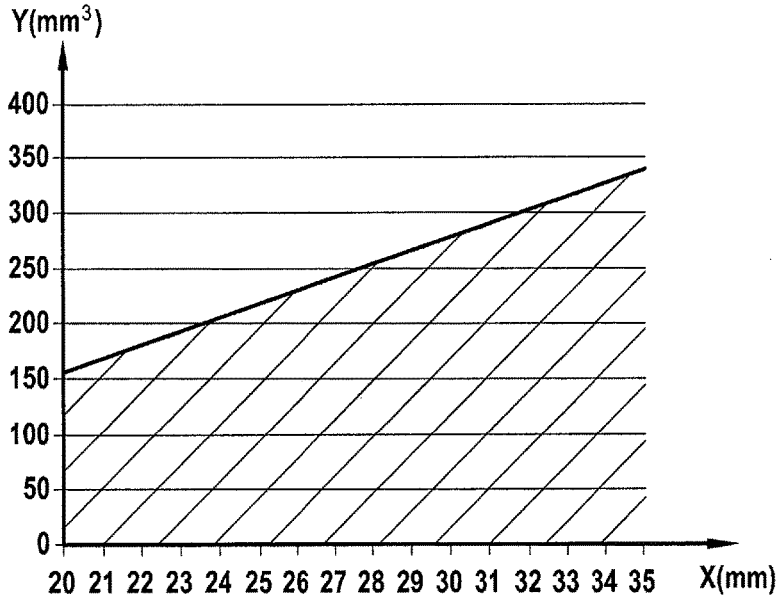
FIG. 2 is a graph showing the relationship that applies to the elements of the FIG. 1 electrical contact.

The free lengths X and the sums Y of volumes of material satisfying relationship (2) are plotted on the graph of FIG. 2 in the zone of the graph that is not crossed-hatched.

Figure 3:
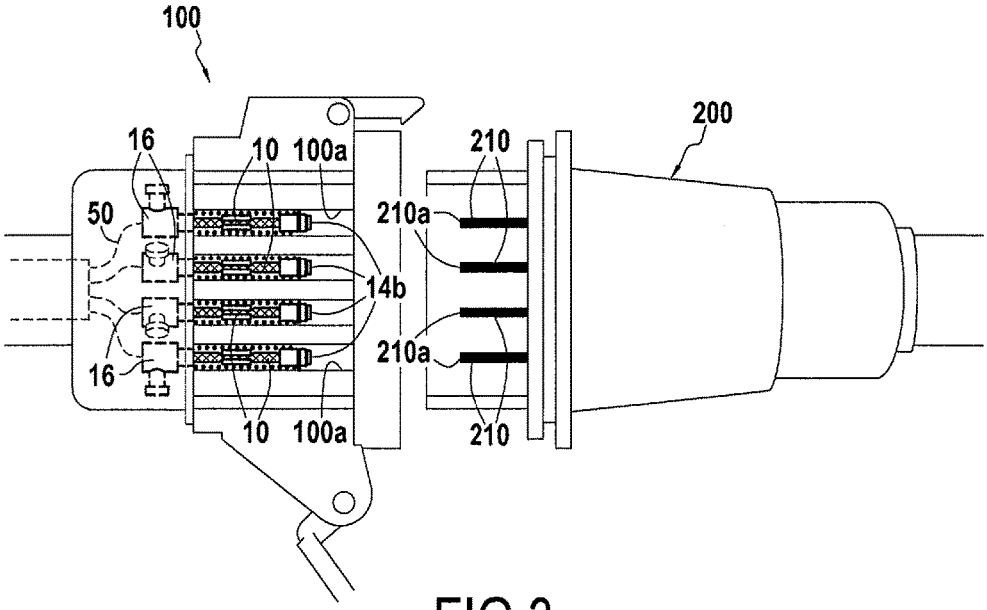
FIG. 3 shows an socket-outlet fitted with the FIG. 1 electrical contact, a complementary movable connection being shown approaching.

FIG. 3 shows a socket-outlet 100 having four electrical contacts 10. Each contact 10 is connected via its connection element 16 to a respective electric wire 50, the wires 50 all being distinct. Each contact 10 is arranged in a receiver 100*a* that forms a confined space and thus imposes a limited size on the part of the contact 10.

In FIG. 3, the movable connection 200 is shown approaching, its pins 210 being end contact type pins, and contacts being made via their distal end faces 210*a*.

Figure 4:
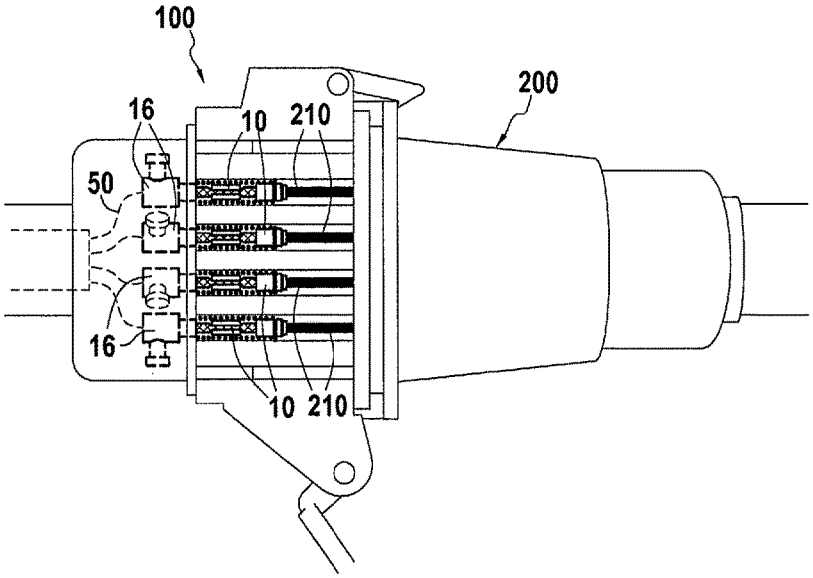
FIG. 4 shows the socket-outlet and the movable connection of FIG. 3 plugged together.

In FIG. 4, the socket-outlet 100 and the movable connection 200 are shown plugged together. The distal end faces 14*b* of the contact heads 14 of the contacts 10 co-operate by bearing against the distal end faces 210*a* of the pins 210, in particular because of the springs 20.

In this example, all of the contacts of the socket-outlet 100 are in compliance with the present description, with one of the contacts forming a ground contact. In a variant, the socket-outlet 100 has only one contact 10, or more than one contact 10.

Although the present invention is described with reference to specific embodiments, it is clear that modifications and changes may be undertaken on these examples without going beyond the general spirit and scope of the invention as defined by the claims. In particular, individual characteristics of the various embodiments shown and/or mentioned may be combined in additional embodiments. Consequently, the description and the drawings should be considered in an illustrative sense rather than restrictive.

The invention claimed is:

1. An electrical contact comprising:

a braid extending longitudinally and presenting a first end and a second end opposite from the first end in the longitudinal direction;

a contact head mounted on the first end; and a connection element mounted on the second end, wherein the free length X of the braid and the sum Y of the volumes of the material of the contact head and the connection element, satisfy the relationship:

$$Y \geq aX - b$$

where a is a number lying in the range 10 to 15, and b is a number lying in the range 80 to 110, Y being expressed in cubic millimeters, X being expressed in millimeters, a being expressed in millimeters squared, and b being expressed in cubic millimeters.

2. The electrical contact according to claim 1, comprising: at least one ring mounted on the braid between the contact head and the connection element, wherein the sum Y of the volumes of the material satisfying the relationship further includes the volume of the at least one ring.

3. The electrical contact according to claim 1, wherein a lies in the range 12 to 13, and b lies in the range 90 to 95.

4. The electrical contact according to claim 1, wherein b lies in the range 93 to 94.

5. The electrical contact according to claim 1, wherein the area of the cross-section of the braid is greater than or equal to 2.0 $mm^2$.

6. The electrical contact according to claim 1, wherein the area of the cross-section of the braid is less than or equal to 3.0 $mm^2$.

7. The electrical contact according claim 1, wherein the contact head comprises a first hollow cylindrical portion receiving the first end of the braid, while the connection element comprises a second hollow cylindrical portion receiving the second end of the braid.

8. The electrical contact according to claim 6, wherein the first hollow cylindrical portion and/or the second hollow cylindrical portion is/are crimped on the braid.

9. The electrical contact according to claim 2, wherein the ring is crimped on the braid.

10. The electrical contact according to claim 1, wherein the braid, the contact head, and the connection element, comprise at least one of copper, a copper-based alloy, silver, and a silver-based alloy.

11. The electrical contact according to claim 2, wherein the ring comprises at least one of copper, a copper-based alloy, silver, and a silver-based alloy.

12. The electrical contact according to claim 1, wherein the contact head is of the end contact type.

13. A socket-outlet including at least one electrical contact according to claim 1.

14. A socket-outlet according to claim 13, wherein said electrical contact forms a ground contact.

* * * * *